United States Patent [19]

Head

[11] Patent Number: 4,615,166

[45] Date of Patent: Oct. 7, 1986

[54] STRUCTURAL PANEL

[75] Inventor: Peter R. Head, Beckenham, England

[73] Assignee: G. Maunsell & Partners, London, England

[21] Appl. No.: 715,287

[22] Filed: Mar. 25, 1985

Related U.S. Application Data

[63] Continuation of Ser. No. 413,504, Aug. 31, 1982, abandoned.

[51] Int. Cl.[4] ..... E04C 2/40

[52] U.S. Cl. ..... 52/309.11; 52/795; 52/799

[58] Field of Search ..... 52/795, 799, 800, 801, 52/309.11, 309.8, 309.9, 729, DIG. 7; 244/123

[56] References Cited

U.S. PATENT DOCUMENTS

| | | | |
|---|---|---|---|
| 2,831,688 | 4/1958 | Knox | 52/799 |
| 3,331,173 | 7/1967 | Elsner | 52/309.11 |
| 3,331,174 | 7/1984 | Wesch | 52/309.11 |
| 3,339,326 | 9/1967 | Derr | 52/309.11 |
| 3,995,080 | 11/1976 | Cogburn | 244/123 |
| 4,057,944 | 11/1977 | Wyatt | 52/799 |
| 4,206,895 | 6/1980 | Olez | 244/123 |

FOREIGN PATENT DOCUMENTS

| | | | |
|---|---|---|---|
| 897995 | 6/1962 | United Kingdom | 52/309.11 |

*Primary Examiner*—John E. Murtagh
*Assistant Examiner*—Richard Chilcot
*Attorney, Agent, or Firm*—Barnes & Thornburg

[57] ABSTRACT

A structural panel (FIG. 1) for use for example in bridge decking has spaced steel sheets (2A, 2B) between which are corrugated stiffening members (3A) of glass fibre reinforced plastics material. The stiffening members (3A) are glued to the spaced sheets (2A, 2B). The voids (15) are filled with plastics foam (4). A strong structure results, in which fabrication costs and maintenance costs are reduced, by virtue of the absence of great lengths of fatigue failure-susceptible welds.

21 Claims, 5 Drawing Figures

STRUCTURAL PANEL

This is a continuation of application Ser. No. 06/413,504 filed Aug. 31, 1982, now abandoned.

FIELD OF THE INVENTION

This invention relates to a structural panel, for use as a unit for example in bridge decking or in the floor of a building, and capable of withstanding compressive loading applied transversely to the panel and also loading applied in the general plane of the panel. The panel comprises spaced sheet members and one or more stiffening members between and rigidly fixed to the spaced sheet members. In its preferred form the structural panel is of sandwich construction with elongate stiffening members between and rigidly fixed to flat parallel sheet members.

The structural panel of the invention may be used for instance in bridge decking, floors of buildings, ships' decks and hulls, and car park floors.

DESCRIPTION OF THE PRIOR ART

Structural panels are known in which a flat sheet steel member is supported on steel ribs, the ribs being connected to the sheet steel member by long welds. This known construction has two main disadvantages: the high cost of fabrication, and the tendency of the long welds to fail in use, leading to high cost of maintenance. The reason for the former is primarily the great amount of skilled welding work involved in welding the numerous decking panels required in for example a road bridge. The reason for weld failure is primarily due to the high flexural stiffness of a steel rib, compared to the low flexural stiffness of the sheet steel member. The sheet steel member flexes over the top of the stiff steel rib, causing eventual weld fatigue failure at points of weld weakness. In maintenance this involves expensive re-welding work.

The problem thus exists of providing a structural panel which is less expensive to make, by avoiding the need for great lengths of expensive welding, and further which avoids weld failures and thus expensive maintenance work. The invention aims to solve this problem and in addition to provide a structural panel which, for a given loading capability, is lighter in weight than known structures.

SUMMARY OF THE INVENTION

According to this invention there is provided a structural panel, for use as a unit for example in bridge decking or in the floor of a building, and capable of withstanding loading applied transversely to the panel and also loading applied in the general plane of the panel, and the panel comprising spaced sheet members and at least one elongate stiffening member rigidly fixed to and between the spaced sheet members, characterized in that (a) the said at least one stiffening member comprises at least one web, the web having ends, and a flange joined to each end of the web; (b) the said at least one stiffening member is of plastics material reinforced with fibrous reinforcement material; (c) the flanges each comprise at least one flange portion disposed at an angle to the web, the said at least one flange portion having inner and outer flange surfaces; (d) said fibrous reinforcement material is provided within the said at least one flange portion and is disposed therein so that it is inclined to the plane of the outer flange surface; and (e) the said outer flange surface is glued, bonded, or otherwise adhered to a respective sheet member. The spaced sheet members may be of for example steel, aluminium or prestressed reinforced concrete. The or each elongate stiffening member is made preferably of glass fibre reinforced plastics material, with the fibres arranged crosswise and also diagonally to the length of the stiffening member. The preferred adhesive is an epoxy resin or a toughened acrylic resin. The plastics material used as the adhesive may be different from the plastics material of which the or each stiffening member is moulded. The stiffening members are preferably moulded by what is known as "pultrusion," that is, the plastics material with mineral fibre reinforcement is pulled from a forming die of the appropriate shape to give the required cross-section, for example an I-section, for a stiffening member of that cross-sectional shape.

In one embodiment of the invention a sandwich-type panel has I-section glass reinforced plastics stiffening beams adhered top and bottom to spaced parallel flat steel sheets, with stiffening beams extending both lengthwise and transversely. The transverse stiffening beams need only be shear-connected to the lengthwise stiffening beams. The voids defined by the stiffening beams between the flat steel sheets are preferably filled with foamed plastics material, to give additional stiffness and corrosion resistance to the structural panel.

Because the elongate stiffening members are of considerably lower flexural stiffness than the sheet members, stress concentrations are not set up in the sheet members due to the attachment of the stiffening members. In addition the stress distribution across the adhesive connections between the stiffening members and the sheet members can be designed to be as uniform as possible by the use of tapering flanges on the stiffening members and arranging the fibre reinforcement in a particular manner. The tendency for the adhesive connections to fail is therefore reduced as compared with the long welds in known decking panels, and lightweight epoxy resin surfacings can be used.

Preferably the glass or other mineral reinforced plastics, and any foam filling material used, has good fire resistant properties so that where it is necessary to weld adjacent metal sheet members together, this can be done.

BRIEF DESCRIPTION OF THE DRAWINGS

An embodiment of the invention will now be described by way of example, with reference to the accompanying drawings, in which.

DESCRIPTION OF THE PREFERRED EMBODIMENT

Figure 1:
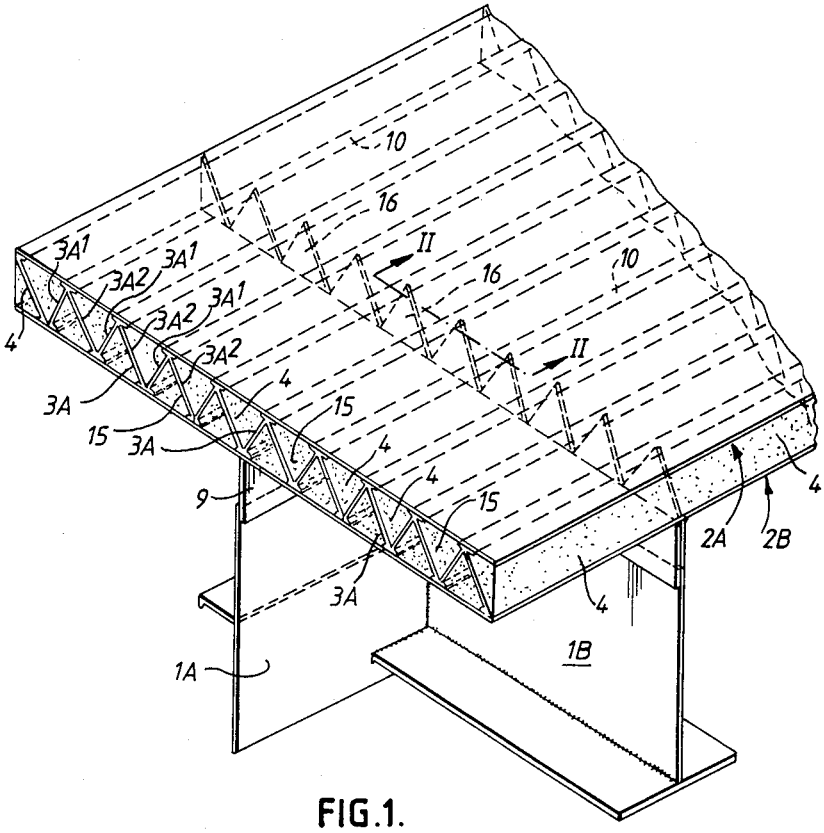
FIG. 1 is a diagrammatic part-sectional isometric view showing a portion of sandwich-type structural panel and supporting structure.

Referring to FIG. 1, there is seen part of a sandwich-type structural panel with part of its supporting structure, the latter including a primary web 1A and a cross girder 1B. The panel comprises two flat, spaced, parallel, steel sheet members 2A, 2B which are glued by an epoxy resin or by a toughened acrylic resin to a series of elongate stiffening members 3A extending in the longitudinal direction as shown. In FIG. 1 three stiffening members 3A are seen. Each of these three elongate stiffening members 3A is a unitary moulded structure made up (FIGS. 1 and 2) of, in effect, three pairs of webs $3A^1$, $3A^2$ of glass fibre reinforced plastics material, with adjacent webs $3A^1$, $3A^2$ being disposed at an angle to one another. Thus the stiffening member 3A is of V-corrugated cross-section with webs $3A^1$, $3A^2$ connected at the apices $3A^3$ of the vees. Each such stiffening member is moulded as a single unitary structure. At the apices $3A^3$ are flanges 10, seen in FIG. 5, which will be described in more detail below.

Although the preferred form of elongate stiffening member 3A is as shown and as described above, other elongate members of moulded, reinforced plastics material could be used for example, the I-section stiffening beams referred to above.

Since the sheet members 2A, 2B are of steel and the elongate stiffening members 3A are of moulded glass fibre reinforced plastics material, it will be understood that they are of different materials and have a different Young's modulus, that of the plastics members 3A being very much less than that of the steel members 2A and 2B.

Other materials can be used, but the material of the sheet members must be different from that of the stiffening members, and the Young's modulus of the stiffening members must be considerably less than that of the sheet members and preferably at least 50% less.

Figure 2:
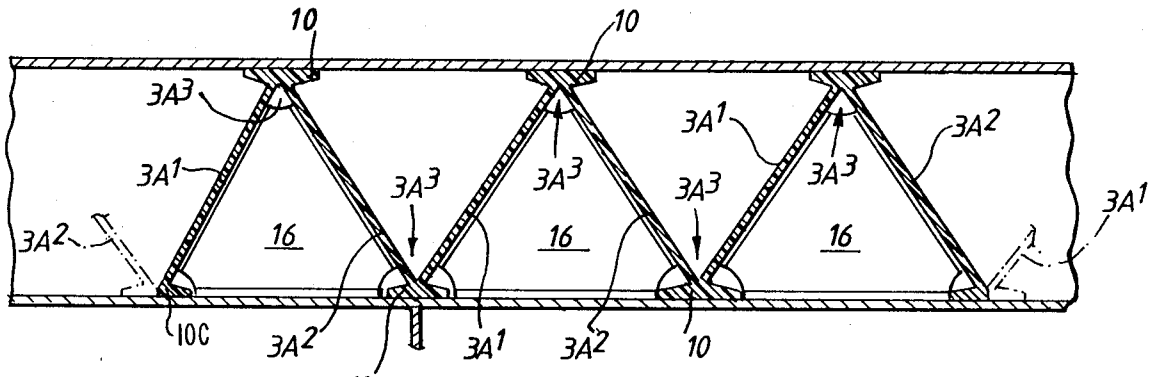
FIG. 2 is an enlarged diagrammatic section taken on the plane II—II of FIG. 1.
Figure 5:
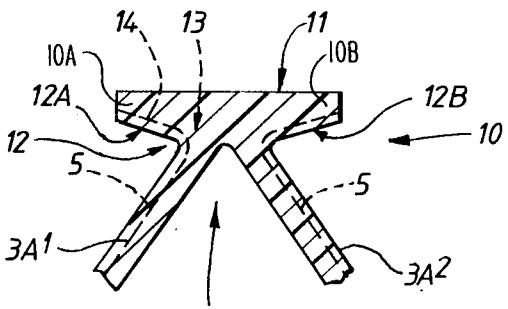
FIG. 5 is a diagrammatic detail section of a flange of a stiffening member.
Figure 4:
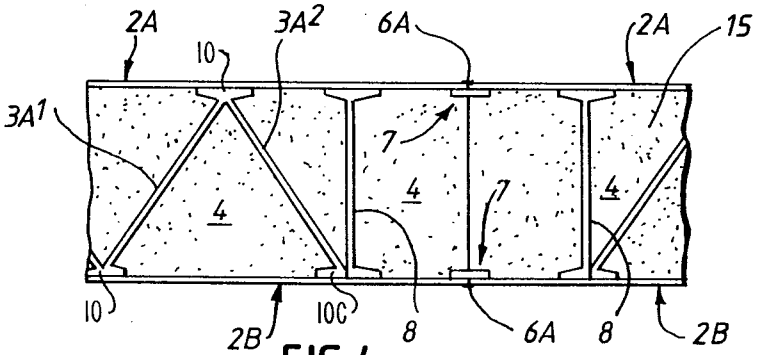
FIG. 4 is a detail section showing a joint between two panels.

FIG. 5 is a diagrammatic detail section of a flange 10. The flanges 10 are integral with the strips $3A^1$ and $3A^2$ of the stiffening member at each apex $3A^3$ the flange 10 has two flange portions 10A, 10B extending in opposite directions, as shown in FIG. 5, although as seen in FIGS. 2 and 4, a flange can comprise a single flange portion 10C. These flange portions 10A, 10B, and 10C are disposed at an angle to the respective web, as shown. The flange 10 is tapered, seen in FIG. 6, and has an outer surface 11 and an inner surface 12. The outer surface 11 is flat and is adhered to the sheet member 2A by adhesive. The inner surface 12 is in two parts 12A, 12B, each lying in a plane which is inclined to the plane of the outer surface 11. The glass fibre reinforcements 5 of each web $3A^1$, $3A^2$ extends up into the respective flange portion 10A, 10B and is bent round as seen at 13 FIG. 5, so that the portion 14 of the reinforcement is inclined to the plane of the outer surface 11 and lies closer to the surface 12 than to the surface 11. By this means the stress distribution across the adhesive connection between a flange surface 11 and a sheet member 2A, 2B can be made more uniform. The tendency of the adhesive connection to fail is in this way kept low, and a lightweight epoxy resin surface covering (not shown) can be used on the top of the sheet member 2A.

The voids or compartments 15 formed between the sheet members 2A, 2B and the strips $3A^1$, $3A^2$ are filled with fire-resistant expanded foam 4.

Referring to FIGS. 1 and 2, glass fibre reinforced plastics diaphragms 16, of generally triangular shape, are fitted in the voids 15 over the cross girder 1B.

Figure 3:
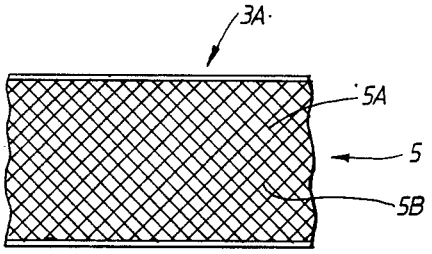
FIG. 3 is a diagrammatic detail elevation of an elongate stiffening member.

The preferred arrangement of glass fibre reinforcement 5 is seen in FIG. 3, with fibres 5A, 5B laid crosswise in the plastics material and also diagonally to the length of the stiffening member 3A. This arrangement of the fibres gives good shear strength and stiffness with low axial stiffness. In this way shear deflection is kept low, as is the variation in field stress in the sheet members 2A, 2B caused by the stiffening members 3A being adhered to them.

FIG. 4 shows a welded connection between adjacent panels, with sheet members 2A, 2A, and 2B, 2B being butt welded together along seam lines 6A, 6B. The welds are backed by metal strips 7. The edge of each panel is sealed by a web 8 of glass reinforced plastics material. The void between the strips 8 and strips 7 is also filled with plastics foam 4, after the panels have been welded together at 6A, 6B.

In the present embodiment, disclosed by way of example, the top and bottom faces of the panel are 200 mm apart; the upper sheet member 2A is of steel 8 mm thick and the lower sheet member 2B of steel 6 mm thick.

The stiffening members 3A are formed by the pultrusion method referred to above.

One possible method of fabrication of the structure shown in FIG. 1 is as follows.

(i) Connecting flats 9 of the primary web 1A and cross girder 1B are welded to the underside of the lower sheet member 2B.

(ii) The upper sheet member 2A is placed upside down on a flat bed (or on a curved bed if camber is required) and the stiffening members 3A are glued down on to the member 2A, at the appropriate spacings.

(iii) Resin adhesive is applied to the free flange surfaces 11 of the stiffening members. The lower sheet member 2B is lifted and placed accurately on the surfaces 11; it is then pushed down firmly by means of rams applied at the locations of the stiffening members, at the same time being heated to cure the resin adhesive. Finally, the plastics foam material 4 is pumped in to fill the voids 15.

The above-described embodiment of structural panel in accordance with the invention is primarily intended for use as a vehicle-supporting surface, for example a bridge deck. But the panel of the invention can have many other applications: one example is the use of a sandwich-type panel to form the bottom flange of a box girder; in this case the plastics stiffening members would be reinforced by a longitudinally arranged fibre reinforcement rather than the diagonally arranged fibre reinforcement described above. Another example is the use of a sandwich-type panel deck in which the two sheet members are aluminium plates: such a deck is very light in weight and can be used for example in a temporary military bridge. A further example is the use of a sandwich-type panel in which the two sheet members are prestressed concrete slabs; such a panel can be for example a floor in a building.

I claim:

1. A structural panel for use as a unit, for example, in bridge decking or in the floor of a building, and capable of withstanding loading applied transversely to the panel and also comprising spaced sheet members and a plurality of elongate stiffening members rigidly fixed to and between the spaced sheet members, characterized in that the stiffening members comprise at least one web, the web having ends, and an integral flange extending from each end of the web;

the flanges each comprising at least one flange portion disposed at an angle to the web, the at least one flange portion having inner and outer flange surfaces, the outer flange surface being glued, bonded, or otherwise adhered to a respective sheet member;

the stiffening members consisting essentially of plastics material reinforced with fibrous reinforcement material, the fibrous reinforcement being provided within the at least one flange portion in a plane inclined to the plane of the outer flange surface; and the flanges comprising two flange portions being sized and positioned on each sheet member such that the said flanges of adjacent webs are spaced from each other by a distance greater than the width dimension of each adjacent flange.

2. The panel of claim 1, wherein the stiffening members are made of a material having a Young's Modulus that is considerably less than the Young's Modulus of the material forming the sheet members causing the flexural stiffness of the sheet members to be proportionally greater than the flexural stiffness of the stiffening members so that flexural movement of each sheet member in relation to the stiffening members attached thereto is reduced.

3. The panel of claim 1, wherein the material forming the stiffening members is different from the material forming the sheet members, and the Young's Modulus of the material forming the stiffening members is either less than or equivalent to about 50% of the Young's Modulus of the material forming the sheet members.

4. The panel of claim 1, wherein the at least one flange portion is tapered causing the inner flange surface to lie in a plane that is inclined in relation to the plane of the outer flange surface.

5. The panel of claim 4, wherein the fibrous reinforcement material provided within the at least one flange portion lies in a plane that is generally parallel to the inner flange surface.

6. The panel of claim 5, wherein the fibrous reinforcement material within the at least one flange portion is located closer to the inner flange surface than to the outer flange surface.

7. The panel of claim 1, wherein the fibrous reinforcement material comprises fibers arranged crosswise and also diagonally to the length of each stiffening member.

8. The panel of claim 1, wherein the fibrous reinforcement material extends from the at least one web and round into the at least one flange portion.

9. The panel of claim 1, wherein each stiffening member comprises two or more webs, adjacent webs being disposed at an angle to one another.

10. The panel of claim 9, wherein each stiffening member is of V-corrugated cross-section with webs connected at the apices of the webs.

11. The panel of claim 10, wherein each stiffening member is formed to position a flange at each apex.

12. The panel of claim 1, wherein the spaced sheet members are flat and mutually parallel.

13. The panel of claim 1, wherein the material forming the spaced sheet members is chosen from the group comprising steel, aluminum, and prestressed reinforced concrete.

14. The panel of claim 1, wherein the sheet members and the elongate stiffening members cooperate to define voids therebetween, the voids being filled with an expanded plastics foam material or the like.

15. The panel of claim 1, wherein the flanges are adhesively joined to the sheet members by a material chosen from the group comprising an epoxy resin and a toughened acrylic resin.

16. In a structural panel of the type having a top sheet member for supporting a load position thereon, a bottom sheet member positioned in spaced-apart relation to the top sheet member, and a plurality of elongate stiffening members bonded to the top and bottom sheet members in interconnecting relation, an improved stiffening member comprising a top portion including a bonding surface rigidly bonded to the top sheet member, first and second bottom portions rigidly bonded to the bottom sheet member in spaced-apart relation so as to straddle the bonded top portion, the top and bottom portions each include at least one integral tapered flange portion having an outer surface forming at least a portion of the bonding surface, the tapered configuration acting to reduce the concentration of stress at each bonded joint, a first web interconnecting the top portion and the first bottom portion, a second web interconnecting the top portion and the second bottom portion, the first and second webs cooperating to define a dihedral included angle therebetween, the top and bottom portions each acting to carry shear-loading forces from the webs of the stiffening member and to distribute such shear-loading forces over the width of the bonded joint between the bonding surface of each top and bottom portion and its respective sheet member, whereby bonding failure of sheet members and interconnected elongate stiffening members is reduced.

17. The improvement of claim 16, wherein the stiffening members are made of a material having a Young's Modulus that is considerably less than the Young's Modulus of the material forming the sheet members causing the flexural stiffness of the sheet members to be proportionally greater than the flexural stiffness of the stiffening members so that flexural movement of each sheet member in relation to the stiffening members attached thereto is reduced.

18. The improvement of claim 16, wherein the top and bottom portions each include an inner flange surface lying in a plane inclined in relation to the outer flange surface, and further comprising fibrous reinforcement material disposed in each tapered flange portion so that the plane in which the fibrous material lies is inclined in relationship to the plane of the outer flange surface.

19. The improvement of claim 18, wherein the fibrous reinforcement material is located closer to the inner flange surface than to the outer flange surface so that applied stress is distributed uniformly across the bonding joint.

20. The improvement of claim 18, wherein the fibrous reinforcement material comprises fibers arranged crosswise and also diagonally to the length of each stiffening member.

21. The improvement of claim 18, wherein the fibrous reinforcement material extends from at least one of the first and second webs into at least one of the top and bottom portions to define a continuum of fibrous reinforcement material.

* * * * *